United States Patent [19]

Brüning

[11] Patent Number: 4,799,801

[45] Date of Patent: Jan. 24, 1989

[54] MIXING DEVICE FOR PASTY MULTICOMPONENT MATERIALS

[75] Inventor: Werner Brüning, Engelskirchen, Fed. Rep. of Germany

[73] Assignee: Alfred Fischbach KG Kunststoff-SpritzguBwerk, Fed. Rep. of Germany

[21] Appl. No.: 169,248

[22] Filed: Mar. 16, 1988

[30] Foreign Application Priority Data

Mar. 18, 1987 [DE] Fed. Rep. of Germany ..... 3708803

[51] Int. Cl.[4] ..... B01F 15/02

[52] U.S. Cl. ..... 366/255; 206/219; 222/136; 366/129; 366/184; 366/332

[58] Field of Search ..... 366/129, 130, 255, 256, 366/257, 258, 267, 268, 184, 332, 333, 334, 335, 292; 222/136, 137, 143; 206/219

[56] References Cited

U.S. PATENT DOCUMENTS

| | | | |
|---|---|---|---|
| 3,735,900 | 5/1973 | Gores | 366/129 |
| 4,193,698 | 3/1980 | Gartner | 206/219 |
| 4,208,133 | 6/1980 | Jungermann | 366/130 |
| 4,676,655 | 6/1987 | Handler | 366/130 |

*Primary Examiner*—Robert W. Jenkins

*Attorney, Agent, or Firm*—Diller, Ramik & Wight

[57] ABSTRACT

The pasty components of a multicomponent material are first contained in separate tubular portions (11,12) which, prior to the mixing operation, are assembled together to form a cartridge (10) having a cylindrical inner wall and in which a mixing means is accomodated which consists of a rotationgly driven disk (21) and of a relatively stationary disk (18). Via a rod (29) projecting out of the cartridge (10), disk (21) is drivable by a rotating tool. By reciprocation of the rotating tool, both disks (18 and 21) are moved axially to the cartridge (10). Upon the mixing performed by displacing and redistributing of the materials, the piston (13) is advanced in order to squeeze the mixture out of the cartridge.

10 Claims, 4 Drawing Sheets

Figure 1:
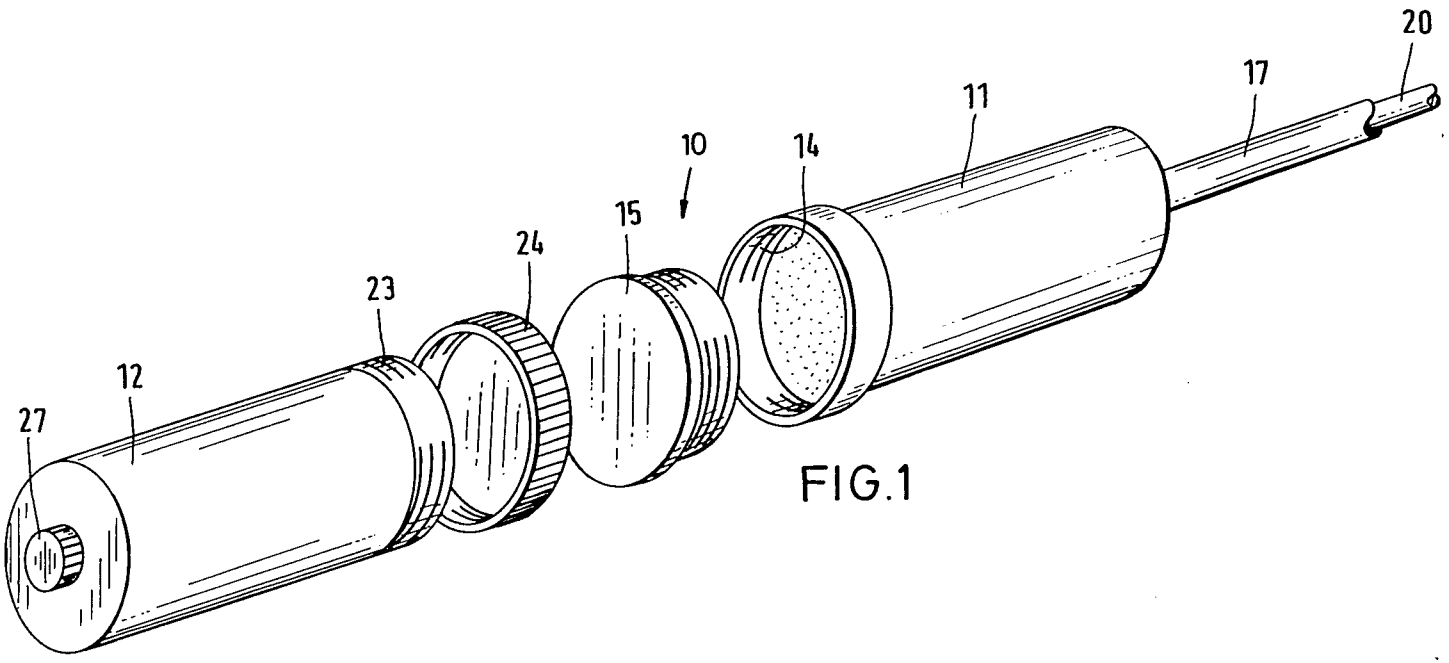

FIG.5
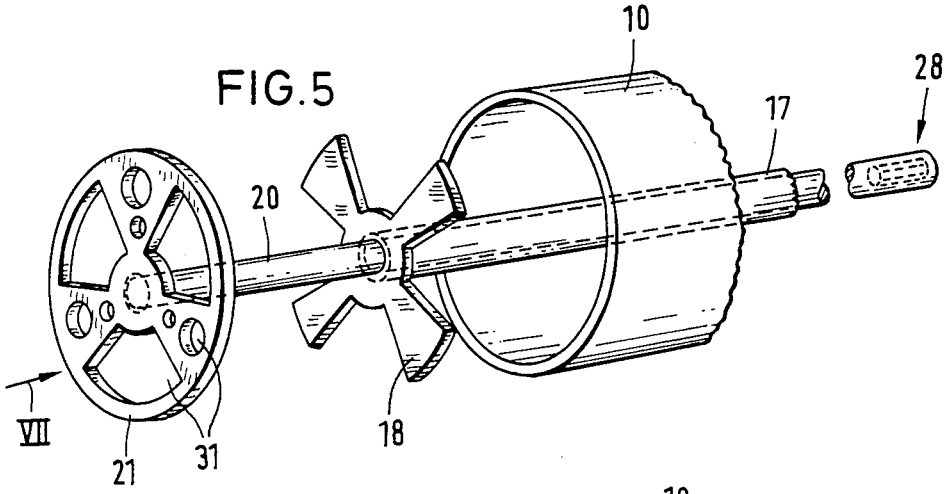
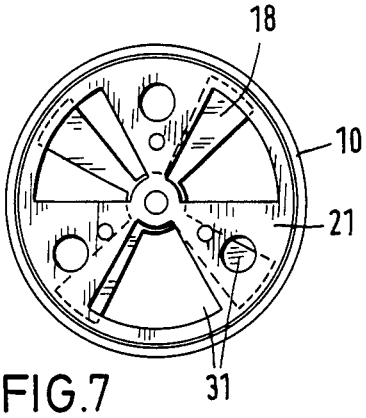
FIG.7
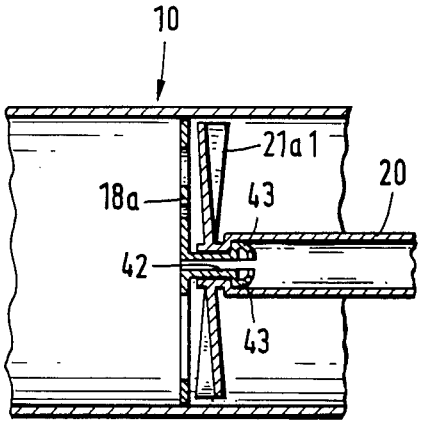
FIG.8
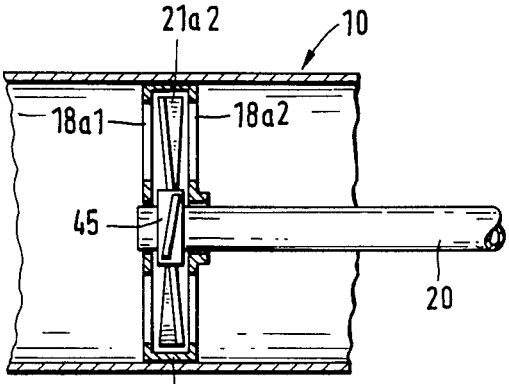
FIG.9

MIXING DEVICE FOR PASTY MULTICOMPONENT MATERIALS

The invention relates to a mixing device, and in particular to a mixing device for mixing the components of adhesive or sealing materials whose crosslinkage is caused or accelerated by uniting a number of components.

It has been known to package one-component adhesive or sealing materials in tubular cartridges made of plastics, aluminum or cardboard which, at one end, contain a displaceable piston, while their other end is provided with a tubular piece or an opening adapted to fix thereto a nozzle. The composition may be squeezed out of the cartridge by a processing tool operated manually or by compressed air. As for multicomponent materials, they have to be intensely intermixed, possibly with the exclusion of air, prior to being squeezed out of the cartridge. To this effect, upon their mixing with a paddle-blade type mixer, the components are filled into the cartridge with the inherent risk that the user may come into contact with an unmixed poisonous component. It has been further known to mix the components in the cartridge by providing an axially displaceable mixing element. However, with a displacement of the mixing member in axial direction only, the pasty components, rather than being intermixed to the required extent, are only separated by the mixing member and the resultant mixture is not homogenous accordingly.

It is the object of the invention to provide a mixing device of the type specified in the precharacterizing part of claim 1 which, by simple handling, enables the user to perform an effective intermixing of the components.

The problem of the invention is solved by the features included in the characterizing part of claim 1.

The mixing device of the invention simultaneously serving for storing, transporting and preserving the mixing components, is used as mixing and applying means. Two tubular portions of which each contains one of the components are put together thus forming a cartridge from which, later on, the mixture may be squeezed out with a customary processing device, e.g. a pistol. Mixing is performed in that to the rod of the mixing member, a rotating driving means, such as a drilling machine, is secured whereby the mixing member is rotated. By simultaneously axially reciprocating the mixing member, the total cartridge volume may be treated by the rotating mixing element. Due to the rotation of the mixing member, the axial displacement is facilitated as well. Upon termination of the mixing operation, the mixture is expelled by advancing the piston in the assembled cartridge. The mixing member forms part of one tubular portion of the cartridge and, at the end of the mixing operation, it is left in the cartridge thus excluding expensive preparatory works and assembly operations for the user.

The mixing member includes two disks of which one rotates, while the other is generally arranged nonrotatingly. The openings of both disks form windows subjecting, due to the rotation of one disk, the pasty material to a shearing effect with the result that said material is continuously redistributed and sheared. The fracturing effect does not only ensure that the material layers are placed against one another, but the materials are also intermixed homogenously.

The used piston is suitably of the annular type enclosing the rod. The piston is guided centrally to inhibit its tilting. This is particularly advantageous, if an air pressure pistol is used during the processing.

Should the rod being connected to the mixing member, form an obstacle when the mixture is expelled, it may be discoupled from the mixing member. Alternatively, the pressure punch of the squeezing tool may be of a tubular design into which the rod may extend and by the end of which the piston is advanced.

Figure 2:
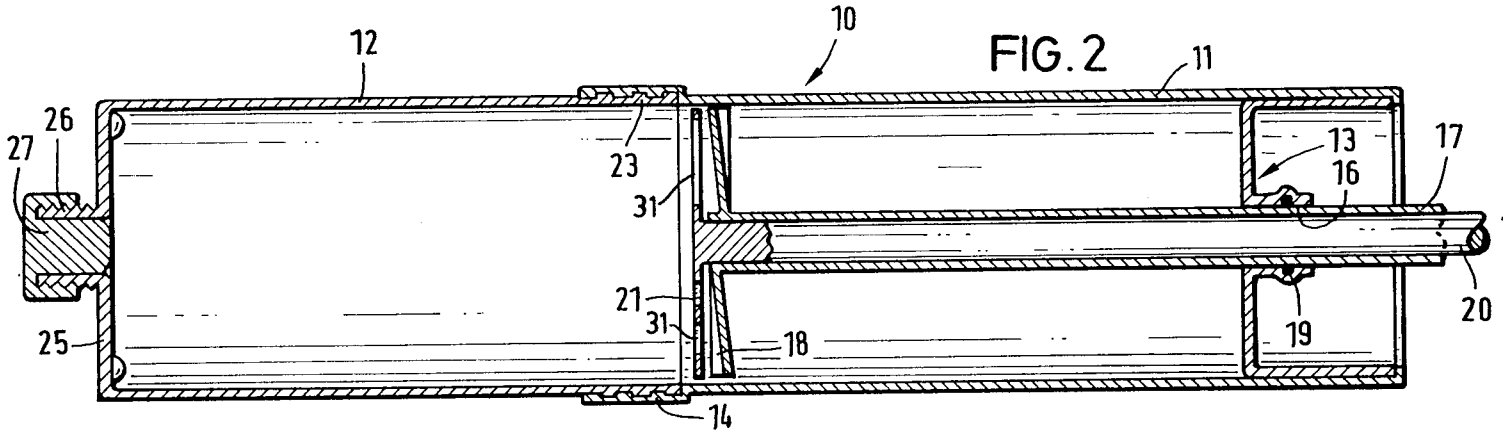
Figure 3:
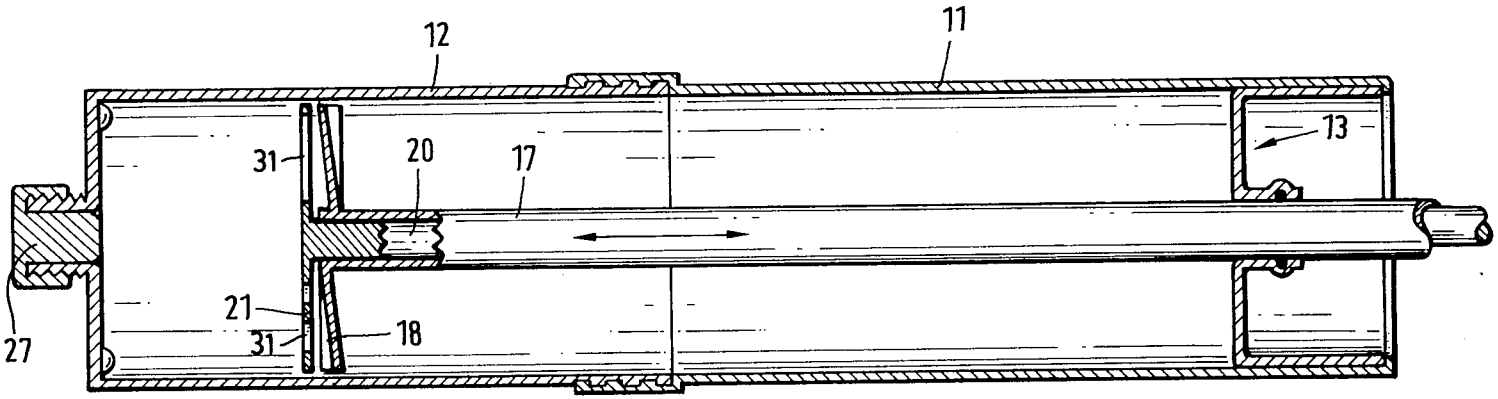
Figure 4:
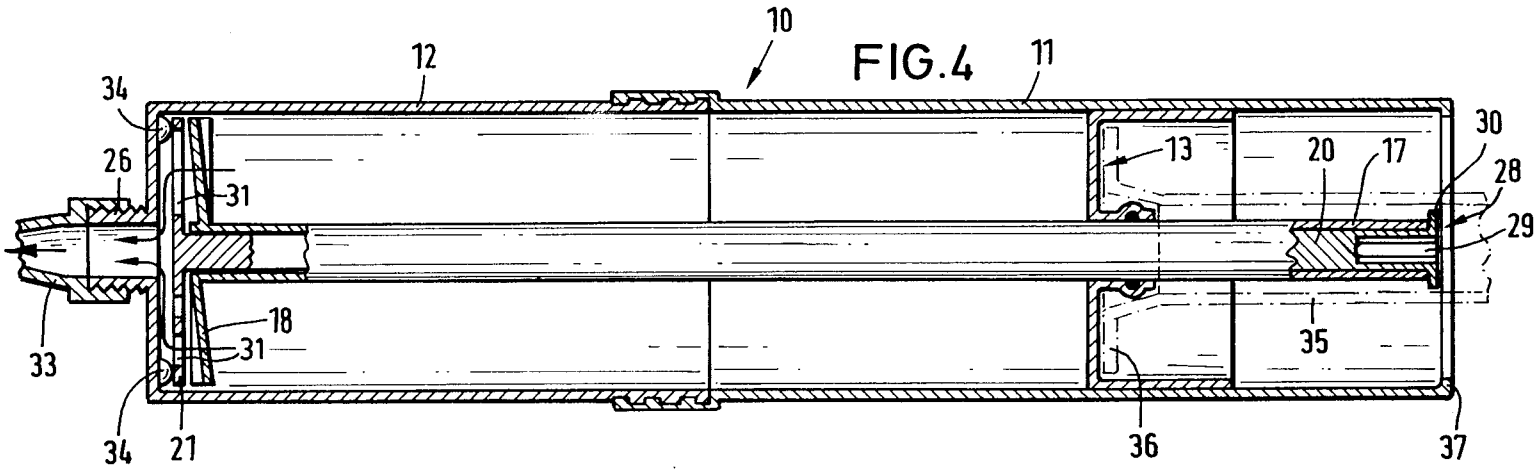
Figure 6:
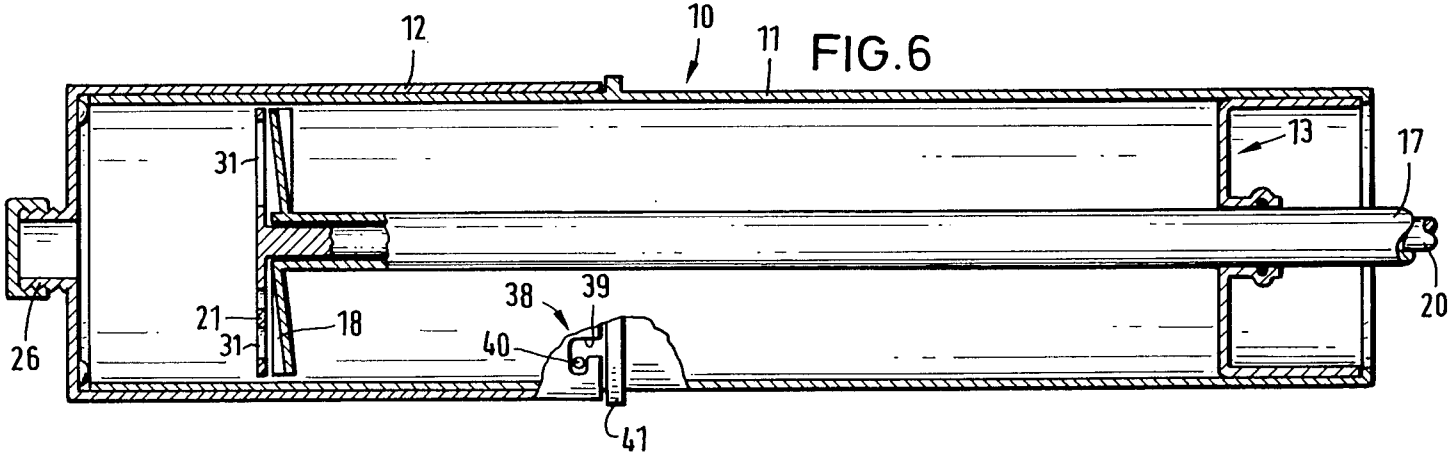

Embodiments of the invention will be explained hereunder in more detail with reference to the drawings in which FIG. 1 shows elements of the mixing device prior to the assembly of the cartridge, FIG. 2 is a longitudinal section of the cartridge directly after its assembly, FIG. 3 illustrates the same view as FIG. 2 to show the situation during mixing, FIG. 4 shows the condition of the cartridge when the mixture is squeezed out, FIG. 5 is an explosive view of the mixing member, FIG. 6 is a second embodiment with the telescopic engagement of the tubular portions, FIG. 7 is a view of the mixing member from the direction of arrow VII of FIG. 5 in assembled condition, FIG. 8 is a longitudinal section of another embodiment of the mixing member and FIG. 9 is a longitudinal section of another embodiment of the mixing member comprising two stationary disks supported frictionally by the cartridge wall.

The cartridge 10 shown in FIGS. 1 to 4 comprises two tubular portions or bodies 11, 12 each of which contains one of the two pasty components to be mixed. The rear end of the rear tubular portion 11 is closed by an axially displaceable piston 13 while its front end is provided with a threaded sleeve 14 provided with an internal thread and having threaded thereinto a plug 15 which completely fills said threaded sleeve. The space for the receipt of the one mixing component is tightly closed this way. Piston 13 is of the annular design in that it contains an axial channel or bore 16 through which extends sealingly a tube 17 whose front end carries the stationary plate or disk 18. Further, due to a sealing ring 19 provided in channel 16, a sealing against the tubular rod 17 is ensured, on the one hand, and, on the other hand, the latter is frictionally retained thus excluding or, at least, braking its rotation. The periphery of piston 13 rests under flexible stress against the cylindrical inner wall of the tubular portion 11, so that, by clamping caused between tubular portion 11 and piston 13 and between the latter and rod 17, the disk 18 is prevented from rotating freely. The front end of another rod 20 traversing coaxially tube 17 and projecting therefrom carries a nonrotatingly fixed disk 21 arranged in closely spaced relationship in advance of and parallel to disk 18, said two disks 18, and 21 forming the mixing member. As illustrated in FIG. 1, rods 17 and 20 extend out of the rear end of tubular portion 11.

The rear end of the tubular portion 12 containing the second mixing component is provided with an external thread 23 adapted to be screwed into the thread of the threaded sleeve 14. If the device is stored, the external thread 23 is provided with a cap 24 screwed on it to close the open rear end of the tubular portion 12. The front end wall 25 at the front end of the tubular portion 12 is provided with a tubular piece 26 through which the mixture may be squeezed out from cartridge 10. For storing purposes, said tubular piece 26 is tightly closed by a threaded plug 27.

In storing condition (FIG. 1), the two components to be mixed are contained in the two tubular portions 11 and 12 thus being separated from one another. If the components are mixed, the covers caps or plugs 15 and 24 are removed from the tubular portions 11 and 12 which are assembled axially, whereby the threaded sleeve 14 is screwed over the external thread 23. In assembled condition, both tubular portions form the cartridge 10. Since both of them have the same inner diameter, the cartridge 10 contains a continuous cylindrical inner space without any steps of the peripheral wall.

The rear end of rod 20 is provided with a coupling means 28 (FIGS. 5 and 6) to which a (non-illustrated) rotating tool is applied, such as a hand-operated drilling machine. The coupling means 28 consists for instance of an axial hexgonal socket 29 and of a radially projecting flange 30. Thus, the rod may be coupled to the rotating tool and driven rotatingly as well as moved axially if the rotating tool is moved correspondingly.

Disk 21 fixed to rod 20 is of a flat design provided with apertures 31 which occupy at least half the disk surface, preferably, at least 70% thereof. The stationary disk 18 which is substantially maintained nonrotatingly by the tubular rod 17 consists, according to the instant embodiment, of an impeller wheel, whose blades are slightly inclined. Between said blades, there are radially open passages.

If the device is used for mixing purposes, the rotating tool coupled to rod 20 is reciprocated axially relative to the cartridge 10, while rod 20 is turned. During its axial movement, rod 20 entrains the tubular rod 17 enclosing it because, by disk 21 and flange 30, said rod 17 is held axially nondisplaceable on rod 20. In other words, the small mutual distance between disks 18 and 21 is maintained, and they cooperate as a mixing member, in which disk 21 is rotating, while disk 18 is stationary and both disks are moved axially.

As evident from FIG. 4, upon termination of the mixing operation, the disks 21, 18 are shifted into the front end position in the vicinity of the connecting piece 26, so that the rear ends of rods 17 and 20 do not project out of cartridge 10. Upon the removal of plug 27, a nozzle 33 is screwed onto the tube or tubular piece 26. The inside of the end wall of the tubular portion 12 is provided with spacers 34 preventing the disks 18 and 21 from adjoining the end wall and from blocking the outlet opening.

For the discharge of the multicomponent mixture, the piston 13 is advanced, after disks 18 and 21 have been put into their front end position, while rods 17 and 20 are completely housed in the cartridge. Thereafter, the tubular pressure punch 35 of the processing tool is introduced into the cartridge 10. Said punch encompasses rods 17 and 20 and, with its front flange 36, it urges against the end wall of piston 13 which is advanced accordingly to squeeze the mixture through the tube 26.

The rear end of the tubular portion 11 is provided with an abutment 37 shaped as an inwardly directed flange formed integrally therewith, said abutment 37 supporting piston 13 which, from the front end, is introduced into the tubular portion 11 before it is filled with the component.

The embodiment of FIG. 6 corresponds to a great extent to the first embodiment so that the following description may be restricted to the explanation of existing differences. The total length of the inner wall of cartridge 10 is formed by the tubular portion 11. The inner diameter of tubular portion 12 generally corresponds to the external diameter of tubular portion 11. The front end of tubular portion 11 is telescopically introduced into the tubular portion 12, and both tubular portions are interlocked by mutual turning with bajonet catches 38. Each bajonet catch 38 consists of an L-shaped slot 39 in the wall of the tubular portion 12 and a pin 40 disappearing in the slot and projecting from tubular portion 11.

Further, the outside of the tubular portion 11 is provided with a radially projecting border or rim 41 forming a stop for the open end of tubular portion 12. Prior to the assembly of the cartridge according to FIG. 6, the tubular portion 11 is filled but only halfwise, with one component, while tube portion 12 is completely filled with the other component. When the front half of the tubular portion 11 is inserted into the tubular portion 12, part of the second component is displaced from the marginal region of the tubular portion 12 to the interior. Upon the interlocking of both tubular portion, mixing is performed in the described manner, and, subsequently, the mixture is squeezed out of the cartridge. According to the embodiment of FIG. 6, rods 17 and 20 project, but only slightly, or not at all out of the tubular portion 11, if the assembly is stored.

FIG. 8 shows an embodiment in which the mixing means consisting of disks **18*a* and 21*a* is connected to one sole rod 20 only to which the rotatable disk 21*a*1 is mounted integrally. Its hub forms a pivot bearing in which hub 42 of disk 18*a* is positioned. Said hub 42 is a slotted radially resilient element engaging with projections 43 the hub of disk 21*a*1 inside the hollow rod 20. By this means, disk 18*a* is rotatably secured to the disk 21*a* or the hollow rod 20** by kind of a clip connection.

The outer diameter of disk **18*a* is slightly superior to the inner diameter of cartridge 10 so that the peripheral surface of disk 18*a* frictionally rests against the inner wall of the cartridge and is prevented from rotating freely. The outer diameter of disk 21*a*1 is of a lesser dimension. In case of FIG. 8, the braked disk of a flat design is provided with through-openings, while the rotatingly driven disk 21*a*1 is formed as a propeller. The sense of rotation is such that the inclined blades drive the material towards the stationary disk 18*a* which is arranged in advance of disk 21*a***.

In case of the embodiment of FIG. 9, only one sole rod 20 is used as well which drives the disk **21*a*2 designed as an impeller wheel. In this embodiment, use is made of two braked disks 18*a*1, 18*a*2 which are arranged on both sides of the rotating disk 21*a*2, said braked disks 18*a*1 and 18*a*2 being integrally interconnected by a wall portion 44 surrounding disk 21*a*2 and frictionally resting against the inner wall of cartridge 10. Disks 18*a*1 and 18*a*2 form a cage enclosing disk 21*a*2. Both disks 18*a*1 and 18*a*2 are positioned on rod 20. Intermediate the two bearings, hub 45 of disk 21*a*2 forms a radial enlargement of rod 20 at which the hubs of both disks 18*a*1 and 18*a*2 are axially supported, so that, with an axial movement of rod 20, the total cage including disks 18*a*1 and 18*a*2 is also moved while hub 45** forms the axial bearing for supporting the cage durng the forward movement and return movement of the mixing member.

In case of the embodiments of FIGS. 8 and 9, the nonrotating disk **18*a*, 18*a*1 and 18*a*2 resp. acts as a stripper, on the one hand, and as a rotary brake, on the other hand. During the mixing operation, a mixing component such as a hardener, may be introduced from the outside through the hollow rod 20**.

What is claimed is:

1. A mixing device for pasty multicomponent materials comprising a tubular cartridge including first and second tubular portions each adapted to house an individual pasty material, mixing means axially displaceable in said tubular cartridge by a rod for admixing the individual pasty materials, said mixing means being a pair of relatively rotatable disks, means for preventing rotation of a first of said disks, aperture means in said disks, a second of said disks being connected to and rotatable by said rod, a piston in said tubular cartridge movable from a first position remote from an outlet end of said tubular cartridge toward a second position adjacent said outlet end whereby admixed pasty material passes through said disk aperture means incident to exiting said tubular cartridge at said outlet end, and said piston is mounted in sliding relationship to said rod.

2. The mixing device as defined in claim 1 including stop means at another end of said tubular cartridge remote from the outlet end thereof for stopping movement of said piston when said piston moves toward said first position.

3. The mixing device as defined in claim 1 including means for lockingly coupling said first and second tubular portions together.

4. The mixing device as defined in claim 1 including detachable cover means for closing one end of each of said tubular portions prior to forming the tubular cartridge therefrom thereby containing the individual pasty material in each tubular portion.

5. The mixing device as defined in claim 1 wherein said first and second tubular portions are at least in partial telescopic relationship to each other.

6. The mixing device as defined in claim 1 wherein said rod is housed generally entirely within said tubular cartridge when said disks are located adjacent said tubular cartridge outlet end.

7. The mixing device as defined in claim 1 wherein said rotation preventing means is defined by surfaces of said tubular cartridge and first disk in frictional engagement.

8. The mixing device as defined in claim 1 including another nonrotating disk adjacent said first nonrotating disk, a circumferential wall connecting said another and first nonrotating disks together, and said rotating disk is housed by said first and another nonrotating disk and said circumferential wall.

9. The mixing device as defined in claim 1 including a tube connected to said nonrotating said rod is housed in said tube and said tube passes through said piston.

10. The mixing device as defined in claim [illegible] wherein one of said disks is a propeller.

* * * * *